US011464320B2

(12) United States Patent
Holtz

(10) Patent No.: US 11,464,320 B2
(45) **Date of Patent: *Oct. 11, 2022**

(54) STORAGE CONTAINER WITH ADJUSTABLE, CONVERTIBLE STRAP

(71) Applicant: Melissa Holtz, Westport, CT (US)

(72) Inventor: Melissa Holtz, Westport, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/301,725

(22) Filed: Apr. 13, 2021

(65) Prior Publication Data

US 2021/0227958 A1 Jul. 29, 2021

Related U.S. Application Data

(63) Continuation of application No. 16/811,631, filed on Mar. 6, 2020, now Pat. No. 10,973,308, which is a continuation of application No. 16/251,457, filed on Jan. 18, 2019, now Pat. No. 10,582,757, which is a (Continued)

(51) Int. Cl.

| | |
|---|---|
| ***A45F 4/02*** | (2006.01) |
| ***A45F 3/04*** | (2006.01) |
| ***A45C 7/00*** | (2006.01) |
| ***A45C 13/36*** | (2006.01) |
| ***A45C 9/00*** | (2006.01) |
| ***A45C 13/00*** | (2006.01) |
| ***A45F 3/00*** | (2006.01) |
| ***A45F 3/14*** | (2006.01) |

(52) U.S. Cl.

CPC ..... *A45F 4/02* (2013.01); *A45C 7/0063* (2013.01); *A45C 13/008* (2013.01); *A45C 13/36* (2013.01); *A45C 2009/007* (2013.01); *A45F 3/005* (2013.01); *A45F 3/04* (2013.01); *A45F 2003/144* (2013.01)

(58) Field of Classification Search

CPC ..... A45F 4/02; A45F 2003/144; A45F 3/005; A45F 3/04; A45C 13/008; A45C 7/0063; A45C 2009/007; A45C 13/36

USPC ..... 224/645

See application file for complete search history.

(56) References Cited

U.S. PATENT DOCUMENTS

| | | | |
|---|---|---|---|
| 467,108 | A | 1/1892 | Cussen |
| 2,533,850 | A | 12/1950 | Syracuse |
| 3,109,394 | A | 11/1963 | Golden |

(Continued)

FOREIGN PATENT DOCUMENTS

| | | |
|---|---|---|
| CN | 201938678 | 8/2011 |
| CN | 102907849 | 2/2013 |

(Continued)

*Primary Examiner* — Nathan J Newhouse
*Assistant Examiner* — Lester L Vanterpool
(74) *Attorney, Agent, or Firm* — Norton Rose Fulbright US LLP

(57) ABSTRACT

A reconfigurable waterproof bag is defined by a plurality of material surfaces extending in three dimensions, a strap for carrying the bag, and one or plurality of strap guide(s) into which the strap is disposed and through which the strap may be moved, the strap guide extending within or without the bag from any one of the plurality of surfaces to any other one of the plurality of material surfaces in three dimensional space without limitation to define a geometry of a strap path and coupling of the strap to the bag so that the bag is reconfigurable in a plurality of different carrying modes.

16 Claims, 13 Drawing Sheets

Related U.S. Application Data continuation of application No. 14/658,135, filed on Mar. 13, 2015, now Pat. No. 10,182,640.

(60) Provisional application No. 61/967,242, filed on Mar. 13, 2014.

(56) References Cited

U.S. PATENT DOCUMENTS 3,198,300 A * 8/1965 Tuttle ..... A45F 3/02 150/108
4,194,602 A * 3/1980 Allen ..... A45F 3/02 224/604
4,213,549 A 7/1980 Hibbard
4,273,274 A * 6/1981 Freistadt ..... A45F 3/04 150/108
4,421,150 A 12/1983 Masters
4,674,664 A * 6/1987 Simon ..... A45F 3/04 224/604
4,974,709 A * 12/1990 Furlow ..... A45C 7/0086 190/102
4,988,216 A * 1/1991 Lyman ..... A45C 11/20 383/110
5,407,112 A 4/1995 Christodoulon et al.
5,415,332 A * 5/1995 Kliot ..... A45F 3/02 150/108
5,431,317 A * 7/1995 Kliot ..... A45F 3/04 224/259
5,490,619 A * 2/1996 Boyar ..... A45C 7/0077 224/613
5,653,337 A 8/1997 Cirigliano
5,797,529 A 8/1998 Lavine
5,797,683 A 8/1998 Gunzi et al.
5,881,932 A * 3/1999 Wadden ..... A45F 3/04 150/108
5,957,324 A 9/1999 Gettelman et al.
5,957,354 A * 9/1999 Mentken ..... A45F 3/04 224/601
6,112,959 A 9/2000 Townsend
6,161,738 A 12/2000 Norris
6,230,950 B1 * 5/2001 Heetman ..... A45C 7/0077 224/901.2
6,286,461 B1 * 9/2001 Martz ..... A01K 1/0254 119/497
6,354,477 B1 * 3/2002 Trummer ..... A45C 9/00 224/582
D458,018 S 6/2002 Mentken
6,435,391 B1 * 8/2002 Vazquez ..... A45C 13/1046 224/613
6,435,392 B1 8/2002 Kennedy
6,460,746 B1 10/2002 Amram
6,488,189 B1 12/2002 Wendell
6,892,915 B2 5/2005 Mares
7,100,809 B2 9/2006 Arnold et al.
7,160,028 B1 1/2007 Linday
D604,084 S 11/2009 Gokhale
8,092,087 B2 * 1/2012 Simhony ..... A45C 15/00 150/108
1,038,351 A1 9/2012 Graham
D692,653 S 11/2013 Platt et al.
8,714,425 B2 5/2014 Meyer
D707,958 S 7/2014 Rubin
8,814,429 B2 8/2014 Roether
8,833,625 B2 9/2014 Giard
9,056,707 B2 6/2015 Ge et al.
9,314,088 B2 4/2016 Lesch
10,407,216 B1 * 9/2019 Glass ..... B65D 33/12
2006/0072857 A1 4/2006 Revels
2006/0153477 A1 * 7/2006 Koguchi ..... A45C 9/00 383/14
2006/0273127 A1 * 12/2006 Simms ..... A45C 13/002 224/576
2007/0108247 A1 5/2007 Bardes
2007/0261977 A1 11/2007 Sakai
2008/0203128 A1 8/2008 Bass et al.
2009/0044309 A1 2/2009 Yarbrough et al.
2009/0208146 A1 8/2009 Kirby
2010/0284631 A1 * 11/2010 Lee ..... A45C 3/06 224/642
2012/0012629 A1 1/2012 Buffinton
2012/0128273 A1 5/2012 Lytle
2013/0008934 A1 1/2013 Liu et al.
2013/0206805 A1 8/2013 Kim et al.
2013/0233901 A1 9/2013 Robinson
2013/0243354 A1 9/2013 Lytle
2013/0292441 A1 11/2013 Shen
2013/0299540 A1 11/2013 Avganim
2014/0367439 A1 12/2014 Valesko
2014/0374450 A1 12/2014 Kruse
2015/0108192 A1 4/2015 Shen

FOREIGN PATENT DOCUMENTS

DE 10055165 6/2002
DE 202005003054 5/2005
DE 102009038025 3/2011
EP 0156328 10/1985
EP 2272773 1/2011
JP H 0556809 3/1993
WO WO 00/62643 10/2000
WO WO 2007/120526 10/2007
WO WO 2008/121013 10/2008
WO WO 2010/017298 2/2010
WO WO 2012/056030 5/2012
WO WO 2013/014425 1/2013
WO WO 2013/029590 3/2013
WO WO 2014/064387 5/2014

* cited by examiner

FIG. 1G
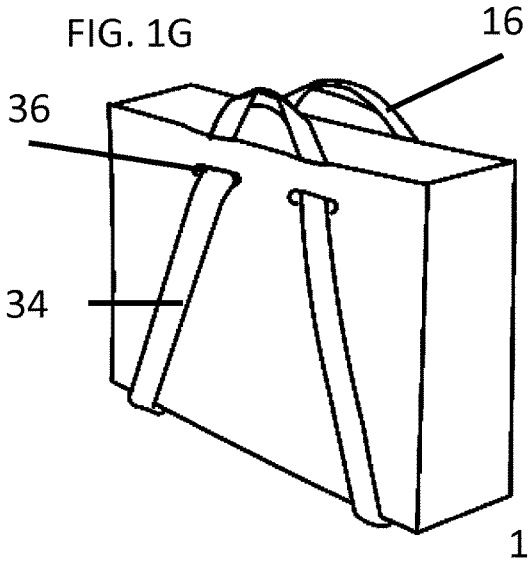
FIG. 1H
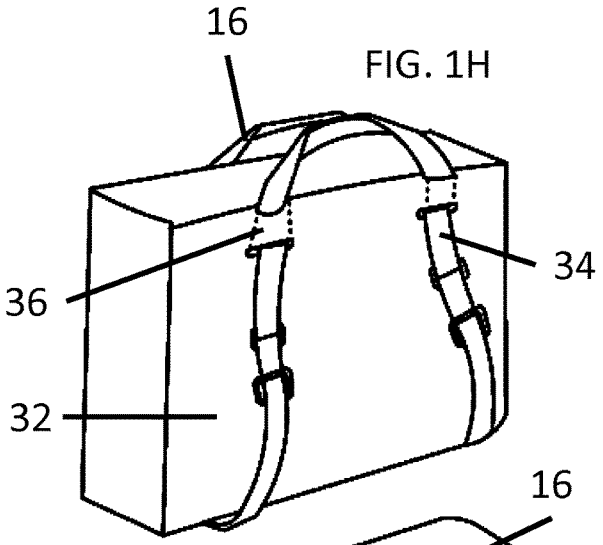
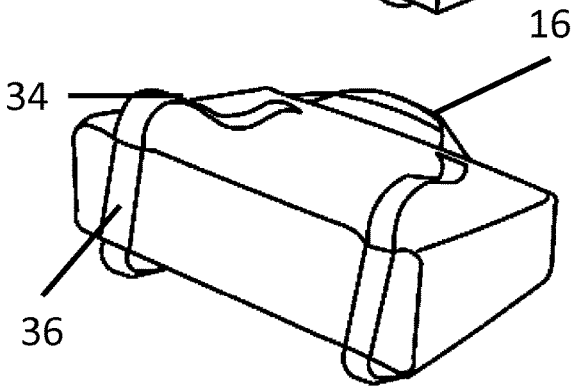
FIG. 1I
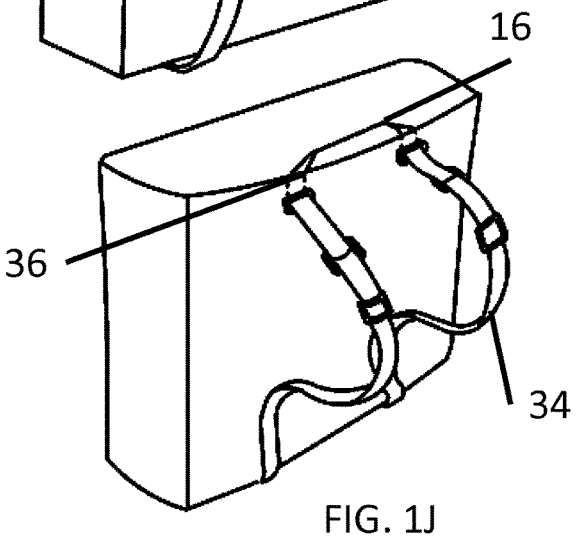
FIG. 1J 14
51
36
103

49
50
48
32
104

49

104

STORAGE CONTAINER WITH ADJUSTABLE, CONVERTIBLE STRAP

CROSS-REFERENCE TO RELATED APPLICATIONS

This application is a continuation of U.S. patent application Ser. No. 16/811,631 filed Mar. 6, 2020, which is a continuation of U.S. patent application Ser. No. 16/251,457 filed on Jan. 18, 2019, which is a continuation of U.S. Pat. No. 10,182,640 filed on Mar. 13, 2015, which claims priority to U.S. Provisional Patent Application No. 61/967,242 filed on Mar. 13, 2014. The entire contents of each of the above-referenced disclosures are specifically incorporated herein.

BACKGROUND OF THE INVENTION

1. Field of the Invention

The illustrated embodiments relate generally to the field of convertible bags capable of being reconfigured into a plurality of carrying modes, such as a shoulder bag or backpack, by reconfiguration of a strap.

2. Description of Related Art

A bag has in its simplest form a storage container or body that can have one or more straps connected or coupled to the bag or no straps at all. Bags are available in many different types and configurations. Different types of bags may offer different advantages over other types of bags. Reconfigurable bags are available for carrying items. However, the existing reconfigurable bags require fixed length or fix placement of the straps, swapping or removing straps, allowing straps to hang free, many multiple fastening attachments, or additional retraction mechanisms, the reconfiguration may also deform the bag into a non-ergonomic shape (See U.S. Publication No. 20130233901, U.S. Publication No. 20070108247, U.S. Pat. No. 5,797,529, CA 2318940 A1, and EP 0156328 A2). Further, none of the configurations are completely waterproof or are convertible while maintaining a waterproof characteristic.

As much as 80% of people in the U.S. have some back pain at some time in their lives making it the most common disability in the U.S. (Marcus, Norman J. End Back Pain Forever: A Groundbreaking Approach to Eliminate Your Suffering. New York: Atria, 2012; Vallfors B. Acute, Subacute and Chronic Low Back Pain: Clinical Symptoms, Absenteeism and Working Environment. Scan J Rehab Med Suppl 1985; 11: 1-982012). Further, back pain is the second most common reason for medical services and missed work days (Mayo Foundation for Medical Education and Research, Diseases and Conditions, Back pain; American Chiropractic Association, Back Pain Facts & Statistics). Back surgeries are the fastest growing type of surgery. Spending on back pain now equals the amount spent on cancer (Marcus, 2012).

Many women in the United States wear or carry a bag, purse or handbag on one shoulder, because they believe it looks more professional than a backpack. Such a bag, when full, can weigh more than 10 pounds. Carrying this weight in a one-shoulder handbag causes lopsided or unbalanced walking, which leads to back issues.

There are no stylish, professional-looking bag options on the market that allow a user to carry this amount of weight with comfort and versatility, while also fully protecting or waterproofing any water sensitive products, such as electronics, they may carry. Users are forced to make a choice either to use a stylish bag with physical discomfort, or be comfortable, but stylishly awkward. One-shoulder bag users typically and subconsciously wear the bag with one shoulder forward and upward to keep the bag "in place" to accommodate the weight. Upper back muscles that stabilize the shoulder blade must struggle to counterbalance that weight. Eventually this leads to muscles being overworked and chronic pain. Worse, this may also cause permanent or semi-permanent curvature of the spine toward the shoulder.

Some reconfigurable bags are known as either a shoulder bag, backpack, or messenger bag by using a continuous strap through an exterior sleeve attached to the outside side surfaces of the bag (U.S. Publication No. 20130233901). One end of the strap attaches to an upper center back portion of the bag, is led to the bottom opening of a sleeve attached to the side of the bag, led up through the sleeve out of the opposing top opening of the sleeve to form a top loop to then be led down into an identical exterior side sleeve attached to the opposing side of the bag, through that sleeve, out the bottom opening and then back up to the upper center portion of the back surface of the back adjacent the attachment point of the opposing end of the strap. The strap can then be pulled to form a single large top loop for carrying the bag as a shoulder bag or pulled into two identically sized loops from the bottom opening of the sleeves to carry as a backpack. Pulling one loop out of the bottom end of the sleeve, but not out of the opposing sleeve, allows the bag to be configured as messenger bag. The design is limited in its configurations because the two exterior sleeves must each lie flatly on the opposing side surfaces of the bag, all straps are fixed length and fixed placement, and the system is not waterproof.

SUMMARY OF THE INVENTION

The subject matter of the present disclosure includes a bag with a system of construction that allows for easy conversion between different carrying modes such as, but not limited to, a shoulder bag, a handheld bag, a briefcase, a bag with hip belt, a handbag, a fanny pack, a clutch, electronics case, weekender, duffle, luggage, a backpack, or a bag configured to attach to any part of the body, or any combination thereof. A strap guide is established to guide a strap in, on, or through the bag, or any combination thereof. The strap is continuous and preferably length adjustable. The strap may be disposed through the strap guide, which may be inside, outside, and/or through the bag or in the case of a bag having a double layer material, additionally disposed between two adjacent layers of material. The strap guide defines the strap geometry and defines the possible movement of the strap from one configuration to another. By pulling in or out loops between the openings to the strap guide at selected locations, loops or handles are created for use in the various configurations of the bag, allowing the bag to be carried in different modes. The bag with its predetermined geometry of a strap guide carrying the strap is preferably waterproof, or at least water or rain resistant, and still maintains a changeable configuration or carrying mode without compromise of its waterproof character. Preferably, the straps is attached to the bag through a waterproof strap guide, such as a system of tunnels or opposing watertight reversibly connectable holes. In one aspect, for waterproofing, one or a plurality of closures or partial closures can be used to seal around the strap to reduce the water on the strap. The bag may include a frame which is reversibly or irreversibly integrated in, on, or through the bag to provide shape or spacing to the bag. Preferably the frame is incorporated into the bag to provide the bag with shape or frame to space it from a user's back to provide a ventilation space between the user's back and the bag.

In certain embodiments, an apparatus of the present invention comprises: a bag having a front, a back, a top, and a bottom, the bag defining an interior compartment and a plurality of exterior surfaces; a strap guide defining a path extending from a first one of the plurality of exterior surfaces to a second one of the plurality of surfaces; and a strap slidably disposed in the strap guide such that the strap is movable to define a plurality of different carrying configurations. In one aspect the apparatus further comprises where the plurality of external surfaces comprises a front and a back surface of the bag. In another aspect, the apparatus comprises where the interior compartment is waterproof. In yet another aspect, the apparatus comprises where the strap is at least one of a continuous length of strap and a plurality of lengths of straps connected to form a continuous length of strap. In one aspect, the apparatus comprises where the strap is at least one of a continuous, adjustable length of strap and a plurality of lengths of straps connected to form a continuous, adjustable length of strap.

In certain embodiments, the apparatus comprises where the apparatus is configurable as at least one of a shoulder bag, a backpack, a messenger bag, a briefcase, a bag with hip belt, a handbag, a fanny pack, a clutch, an electronics case, a weekender, a duffle, a luggage bag, and a bag configured to attach to any part of the body.

In certain embodiments, the apparatus comprises a strap guide comprising a plurality of tunnels. In one aspect the tunnel has opposing ends and where at least one of the opposing ends is coupled to an opening defined in one of the plurality of exterior surfaces. In another aspect, the at least one of the opposing ends is coupled to the opening in a waterproof coupling.

In certain embodiments the apparatus further comprises at least one of a stop coupled to the strap and a strap configured to include a portion of the strap which is shaped to provide an interference stop at a strap guide.

In certain embodiments the apparatus further comprises at least one of a waterproof closure and a water absorbing closure, the closure configured to be in contact with the strap and configured to reduce water from the strap as the strap is moved through the closure. In one aspect, the apparatus the closure comprises at least one of a slit defined by a material piece through which the strap is disposed, a clamp, a funnel, a cap, a gasket, a squeegee, a roller, a pressure plate, and a pressure bar. In another aspect, the bag defines an opening on an exterior surface coupled to the strap guide wherein the strap is disposed through the opening; the bag further comprising at least one of a waterproof closure and a water absorbing closure disposed in the opening and configured to seal the opening when the strap is disposed therethrough and to reduce water from the strap as it is moved through the opening.

In certain embodiments, the apparatus further comprises a connector assembly coupled to the strap guide, the connector assembly having a first mating component and a second mating component, the bag further comprising where the bag defines a first opening on one or more of the plurality of exterior surfaces and a second opening on one of the plurality of exterior surfaces, the first mating component mounted in the first opening and the second mating component mounted in the second opening, the strap being disposed through both the first and second opening, the first and second mating components capable of being selectively joined together to form a waterproof seal between the components and configured to allow the strap to be slidably disposed through the connector assembly. In one aspect, the connector assembly comprises a gasket, the gasket configured to render the connector assembly waterproof when the first and second mating components are selectively joined together. In another aspect, the mating components of the connector assembly are configured to selectively join together with at least one of a tongue-in-groove seal, a snap seal, and a magnetic seal; and where the seal is configured to render the connector assembly waterproof when the first and second mating components are selectively joined together.

In certain embodiments, the apparatus further comprises where the apparatus has a back exterior surface and a frame integrated with the bag, the frame configured to provide at least one of a shape of the bag and a spacing of the bag, and wherein the frame is configured to create a ventilation space between the back surface of the bag and a user carrying the bag. In one aspect, the apparatus further comprises a frame wherein at least part of the frame is configured to be capable of being reversibly bowed by tension. In another aspect, the apparatus comprises a bag with a connector for the frame, the connector configured to integrate the frame with the bag; and the bag further comprising an additional connector for the frame, the connector configured to integrate a frame that is bowed by tension with the bag. In yet another aspect, the apparatus further comprises a tensioner coupled to the frame wherein the tensioner is configured to bow the frame when the tensioner is at least one of adjusted and coupled to the frame.

In certain embodiments, the bag may include i) wherein the bag defines an interior compartment that is waterproof, ii) at least one stop coupled to the strap or wherein the strap is configured to contain a portion of the strap which is wider or of a different shape than an opening in the bag and capable of stopping the strap from traveling further through the opening, iii) at least one waterproof or water absorbing closure or partial closure in contact with the strap wherein the closure or partial closure reduces or extracts water from or on a strap as the strap is moved through the closure or partial closure, and iv) wherein the strap is a continuous length of strap or comprises a plurality of lengths straps connected to form a continuous length of strap. In one instance, the bag may further include a frame wherein the frame is configured to create a ventilation space between the back surface of the bag and a user carrying the bag. In one instance the bag includes a frame that at least part of the frame is capable of being bowed by tension. In another instance the bag includes a connector for the frame to integrate the frame with the bag and at least one additional connector for the frame that connects a frame that is bowed by tension to the bag. In yet another instance, the bag includes a tensioner coupled to the frame wherein the tensioner can be adjusted to bow the frame.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112.

The use of the word "a" or "an" when used in conjunction with the term "comprising" in the claims and/or the specification may mean "one," but it is also consistent with the meaning of "one or more," "at least one," and "one or more than one."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The apparatuses and methods for their use can "comprise," "consist essentially of," or "consist of" any of the elements or steps disclosed throughout the specification.

As used in this specification and claim(s), the words, "at least one of" A, B, "and" C, means any one of A, B, or C, or any combination thereof. As an example, "at least one of X, Y, and Z," means X, Y, Z, X+Y, X+Z, or Y+Z. As another example, "at least one of a D and a E", means D, E, or D+E.

Other objects, features and advantages of the present invention will become apparent from the following detailed description. It should be understood, however, that the detailed description and the examples, while indicating specific embodiments of the invention, are given by way of illustration only. Additionally, it is contemplated that changes and modifications within the spirit and scope of the invention will become apparent to those skilled in the art from this detailed description.

The disclosure can be better visualized by turning now to the following drawings wherein like elements are referenced by like numerals.

BRIEF DESCRIPTION OF THE DRAWINGS

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

FIG. 1A-1M include various perspective views of an embodiment of a bag that is configured either into a shoulder bag, backpack, messenger bag, hand bag, wrist bag, and fanny pack according to the teachings of the invention.

DESCRIPTION OF ILLUSTRATIVE EMBODIMENTS

Figure 1A:
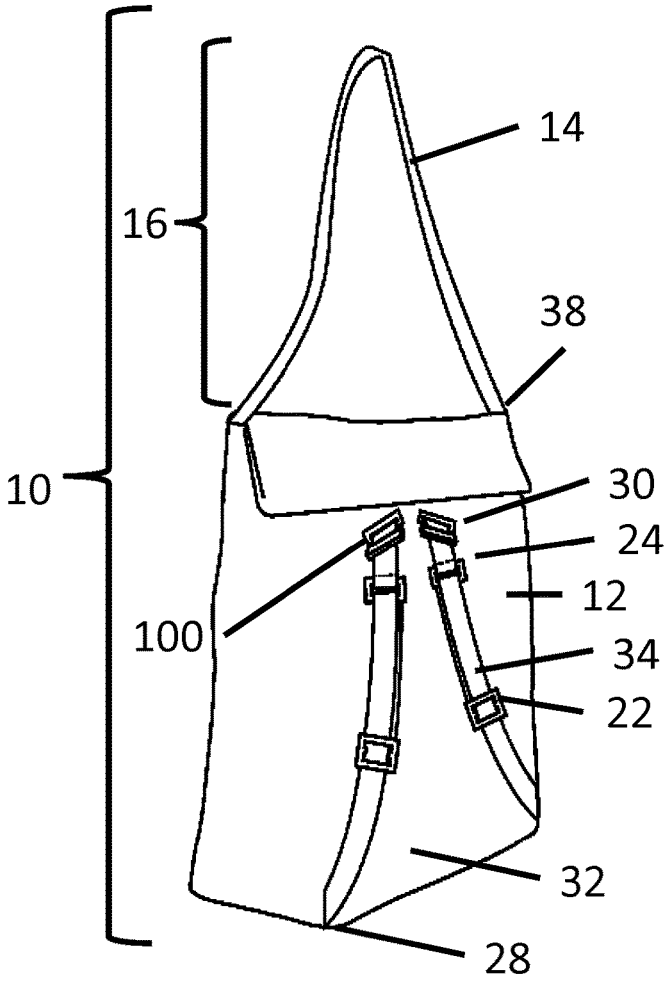

A device or structure that is configured in a certain way is configured in at least that way, but it may also be configured in ways other than those specifically described.

The subject matter of the present disclosure includes a bag with a system of construction that allows for easy conversion between different carrying modes such as, but not limited to, a shoulder bag, a handheld bag, a briefcase, a bag with hip belt, a handbag, a fanny pack, a clutch, electronics case, weekender, duffle, luggage, a backpack, or a bag configured to attach to any part of the body, or any combination thereof. Non-limiting examples or parts of the body on which a bag may attach include around the arm, wrist, leg, ankle, torso, shoulders, neck, hips, or head. A strap guide is established to guide a strap in, on, or through the bag, or any combination thereof. The strap guide may include, but is not limited to, one or a plurality of hidden or exposed passageway(s), loop(s), ring(s), hook(s), enclosure (s) or partial enclosure(s), opening(s), or tunnel(s) with opposing ends, or any combination thereof. The strap guide may be established at selected locations on the bag to create a pattern of openings in, on, or through the bag through which a strap can be led. The strap is continuous and preferably length adjustable. The strap may be disposed through the strap guide, which may be inside, outside, and/or through the bag or in the case of a bag having a double layer material, additionally disposed between two adjacent layers of material. The strap guide defines the strap geometry and defines the possible movement of the strap from one configuration to another. By pulling in or out loops between the openings to the strap guide at selected locations, loops or handles are created for use in the various configurations of the bag, allowing the bag to be carried in different modes.

Preferably the portion of the straps, which are not serving as a loop or handle for carrying, remain flush against the bag after changing the configuration of the bag to a different carrying mode so that no unused, dangling straps are present. The continuous strap allows the carrying configuration to change by pulling the straps in or out of the strap guide without detaching and reattaching the strap. The fitting of the continuous strap in the strap guide also allows the strap to move easily as it is adjusted in length. The strap can have adjusters to change its length. The strap can also have a stop mechanism or fasteners to lock the strap in or to fasten the strap to itself.

The bag with its predetermined geometry of a strap guide carrying the strap is preferably waterproof, or at least water or rain resistant, and still maintains a changeable configuration or carrying mode without compromise of its waterproof character. The bag may define a waterproof interior compartment. The bag can also include a water repelling or absorbing apparatus disposed in the openings of the strap guide to seal the opening when the strap is disposed therethrough, into, or out of the strap guide(s) and to wipe or absorb water from the strap as it is moved through the opening into or out of the strap guide(s). The water repelling or absorbing apparatus can be, but is not limited to, one or a plurality of a squeegee, gasket, funnel, cap, slit, roller, pressure plate or bar, molded grommet, or sponge, or any combination thereof. The water repelling or absorbent apparatus may be made of, but is not limited to, silicone, plastic, metal, cloth, sponge, Teflon, etc. On one embodiment, the water repelling or absorbing apparatus can also act as a gate or locking mechanism. In one instance the water repelling or absorbing apparatus acting as a gate or locking mechanism can inhibit movement of the strap through a strap guide.

Wherever the term, "waterproof" is used, it is to be understood to include conditions also described by the terms, "waterproof, water tight, water resistant, or rain resistant". The bag can even be completely submerged in water briefly and the inside of the bag will stay dry because of the nature of the straps' engagement with the bag through a closed strap guide, such as a system of tunnels.

In certain aspects, the straps is attached to the bag through a waterproof strap guide, such as a system of tunnels or opposing watertight reversibly connectable holes. The tunnels can either move within the bag's exterior or through the bag interior. Even though the interior tunnels go through the bag, any water on the strap goes through the tunnel without entering the interior compartment of the bag. The watertight reversibly connectable holes can have a tunnel between them or without a connecting tunnel, the watertight reversibly connectable holes are only waterproof when closed or coupled to an opposing hole.

In one embodiment, for waterproofing, one or a plurality of closures or partial closures provided at a strap guide opening can be used to seal around the strap as it is led into or out of the strap guide opening. In another embodiment, one or a plurality of closures may be used to waterproof the seal between the strap and the opening in the strap guide. In yet another embodiment, the closures may be slidably connected to the strap. In one embodiment the closure may be reversibly connected to the strap. In one instance, the closures or partial closures will strip most or all of the water from straps and thereby prevent the straps from carrying water into the strap guide. One or a plurality of closures may be, but is not limited to, gasket(s), clamp(s), funnel(s), cap(s), squeegee(s), roller(s), pressure plate(s) or bar(s), or Goodyear welt style closure(s), or any combination thereof. In one instance the closure is a squeegee, wherein the squeegee forms a funnel. In another instance, the closure is a pair of squeegees, wherein the pair of squeegees are configured to form an opening that is smaller than a cross section of the continuous strap when the continuous strap is not disposed therethrough. In yet another instance, the closure comprises a pair of squeegees configured to form a slit. In one instance, the closure or partial closure comprises an awning of fabric. In some embodiments, the closures include a clamp mechanism to tightly seal around the strap and therefore let less water into the strap guide. In one instance, the closure mechanism may also lock the strap in position allowing the bag to be supported by the strap. In another instance, the closure or partial closure is configured to be reversibly attached to an opening defined by an external surface of the bag. In yet another instance, the closure or partial closure comprises a hinge configured to allow the closure or partial closure to open or close.

Where water might collect in the strap guide, and, in order to remove that water, drains or waterproof breathable membranes may be incorporated into the strap guide to allow water to exit or escape. In one instance the strap guides are non-absorbent or waterproof. In another instance the strap guides are made of quick drying material. In yet another instance, the strap guide is made of antibacterial materials. In one instance, the strap guide is configured to be opened for ease of cleaning. In another instance, the strap guide is exterior to the bag. In yet another instance, the strap guide is connected to an outside surface of the exterior surface of the bag. In yet another instance an exterior strap guide is configured to allow air flow into the strap guide. Non-limiting examples of a ventilated external strap guide includes, but is not limited to, a three sided channel, trough, or rail system. In one instance the external strap guide comprises a waterproof backing that prevents water from entering the interior compartments of the bag.

The bag may include a connector assembly coupled to the strap guide which can define two openings in one or a plurality of the internal or external surfaces of the bag. The connector assembly may include two mating components, each mating component mounted in one of the two openings. The strap can be disposed through the two openings and the mating components. The mating components are preferably capable of being selectively joined together to form a waterproof seal between the components while allowing the strap to be disposed through and movable through the connector assembly.

For waterproofing, the connector assembly mating components can preferably couple with a tongue-in-groove seal, snap seal, or magnetic seal, or combination thereof to render the connector assembly waterproof when closed.

The bag may include a frame which is reversibly or irreversibly integrated in, on, or through the bag to provide shape or spacing to the bag. Preferably the frame is incorporated into the bag to provide the bag with shape or frame to space it from a user's back to provide a ventilation space between the user's back and the bag. In one embodiment, the frame is flexible and may be bowed by tension applied to the frame. Preferably, a flexible frame is configured to only flex from flat or nearly flat to concave in relation to the back of the user to provide a ventilation space between the user's back and the bag. In another embodiment, the frame may connect with the bag by connectors that are spaced to accommodate a bowed frame. In yet another embodiment, the frame may connect with the bag by connectors that are spaced to accommodate a non-bowed frame. In one another embodiment, there are more than one set of connectors to accommodate a frame or multiple frames. In another embodiment the connectors are arranged to accommodate at least two different orientations or shapes of the frame. In another embodiment, the connectors may be rearranged or reoriented by the user. The connector can be, but is not limited to, one or more of a grommet, pocket, sleeve, pin, bolt, hook, loop, strap, and similar items. The frame can be coupled to a tensioner that applies tension to the frame by adjusting the tensioner. The tensioner may be, but is not limited to, a strap, an adjustable strap, a wire, a threaded rod or bolt, or similar items. The frame can comprise, but is not limited to, resilient poles, tubes, a U shaped flexible material, a hinged shelf, or an inflatable frame. The frame material can be made of, but is not limited to, flexible metal, plastic, fiberglass, straps, cords, or a similar material, or a combination thereof. Preferably, the frame can, when bowed, create a ventilation space between the back surface of the bag and the user.

In certain embodiments, the components of the frame can be pivotally attached to each other. In one instance, the frame is configured in the shape of an X. In another instance the X shaped frame includes an anchor to maintain the X shape of the frame. In one instance the X shaped frame is configured to sit on the users waist. In another instance, the X shaped frame is one piece. In yet another instance, the X shaped frame is two overlapping pieces. In one instance, the X shaped frame is more than two pieces. In another instance, the X shaped frame is collapsible.

In certain embodiments, the frame is configured to allow air to flow in and out of the structure of the frame. In one instance the frame is configured to allow air to flow in and out of the structure of the frame at portions of the frame that are external to the bag. In another instance, the frame is configured to allow air to flow from outside of the bag into an internal portion of the bag. In one instance, the frame may be made of, but is not limited to, a mesh material, a perforated tunnel, or an open ended tunnel.

In certain embodiments, the frame comprises a hinged shelf wherein the hinged shelf is configured to be able to be oriented between perpendicular to the back exterior surface of the bag and parallel to the back exterior surface of the bag. In one instance, the hinged shelf further comprises a locking mechanism to lock the orientation of the hinged shelf.

In certain embodiments, the frame comprises a U or similarly shaped flexible material wherein the frame is configured to bow when two of the terminal ends of the flexible material are moved closer to each other. In one instance there is connector configured to lock the two terminal ends together.

In certain embodiments, the frame comprises an inflatable frame. In one instance, the frame is waterproof. In another instance, the frame is connected to the bag in a waterproof connection. In yet another instance, the frame is connected to the bag using plastic welding.

Also disclosed are the following Embodiments 1 to 20 of the present invention. Embodiment 1 is an apparatus comprising: a bag having a front, a back, a top, and a bottom, the bag defining an interior compartment and a plurality of exterior surfaces; a strap guide defining a path extending from a first one of the plurality of exterior surfaces to a second one of the plurality of surfaces; and a strap slidably disposed in the strap guide such that the strap is movable to define a plurality of different carrying configurations. Embodiment 2 is the apparatus of Embodiment 1 where the plurality of external surfaces comprises a front and a back surface of the bag. Embodiment 3 is the apparatus of Embodiment 1 where the interior compartment is waterproof. Embodiment 4 is the apparatus of Embodiment 1 where the strap is at least one of a continuous length of strap and a plurality of lengths of straps connected to form a continuous length of strap. Embodiment 5 is the apparatus of Embodiment 1 where the strap is at least one of a continuous, adjustable length of strap and a plurality of lengths of straps connected to form a continuous, adjustable length of strap. Embodiment 6 is the apparatus of Embodiment 1, where the apparatus is configurable as at least one of a shoulder bag, a backpack, a messenger bag, a briefcase, a bag with hip belt, a handbag, a fanny pack, a clutch, an electronics case, a weekender, a duffle, a luggage bag, and a bag configured to attach to any part of the body. Embodiment 7 is the apparatus of Embodiment 1 further comprising a strap guide comprising a plurality of tunnels. Embodiment 8 is the apparatus of Embodiment 7 where the tunnel has opposing ends and where at least one of the opposing ends is coupled to an opening defined in one of the plurality of exterior surfaces. Embodiment 9 is the apparatus of Embodiment 8 where the at least one of the opposing ends is coupled to the opening in a waterproof coupling. Embodiment 10 is the apparatus of Embodiment 1 further comprising at least one of a stop coupled to the strap and a strap configured to include a portion of the strap which is shaped to provide an interference stop at a strap guide. Embodiment 11 is the apparatus of Embodiment 1 further comprising at least one of a waterproof closure and a water absorbing closure, the closure configured to be in contact with the strap and configured to reduce water from the strap as the strap is moved through the closure. Embodiment 12 is the apparatus of Embodiment 11 wherein the closure comprises at least one of a slit defined by a material piece through which the strap is disposed, a clamp, a funnel, a cap, a gasket, a squeegee, a roller, a pressure plate, and a pressure bar. Embodiment 13 is the apparatus of Embodiment 11 where the bag defines an opening on an exterior surface coupled to the strap guide wherein the strap is disposed through the opening; the bag further comprising at least one of a waterproof closure and a water absorbing closure disposed in the opening and configured to seal the opening when the strap is disposed therethrough and to reduce water from the strap as it is moved through the opening. Embodiment 14 is the apparatus of Embodiment 1 further comprising a connector assembly coupled to the strap guide, the connector assembly having a first mating component and a second mating component, the bag further comprising where the bag defines a first opening on one or more of the plurality of exterior surfaces and a second opening on one of the plurality of exterior surfaces, the first mating component mounted in the first opening and the second mating component mounted in the second opening, the strap being disposed through both the first and second opening, the first and second mating components capable of being selectively joined together to form a waterproof seal between the components and configured to allow the strap to be slidably disposed through the connector assembly. Embodiment 15 is the apparatus of Embodiment 14 where the connector assembly comprises a gasket, the gasket configured to render the connector assembly waterproof when the first and second mating components are selectively joined together. Embodiment 16 is the apparatus of Embodiment 14 where the mating components of the connector assembly are configured to selectively join together with at least one of a tongue-in-groove seal, a snap seal, and a magnetic seal; and where the seal is configured to render the connector assembly waterproof when the first and second mating components are selectively joined together. Embodiment 17 is the apparatus of Embodiment 1 further comprising where the apparatus has a back exterior surface and a frame integrated with the bag, the frame configured to provide at least one of a shape of the bag and a spacing of the bag, and wherein the frame is configured to create a ventilation space between the back surface of the bag and a user carrying the bag. Embodiment 18 is the apparatus of Embodiment 17 further comprising a frame wherein at least part of the frame is configured to be capable of being reversibly bowed by tension. Embodiment 19 is the apparatus of Embodiment 17 further comprising a bag with a connector for the frame, the connector configured to integrate the frame with the bag; and the bag further comprising an additional connector for the frame, the connector configured to integrate a frame that is bowed by tension with the bag. Embodiment 20 is the apparatus of Embodiment 17 further comprising a tensioner coupled to the frame wherein the tensioner is configured to bow the frame when the tensioner is at least one of adjusted and coupled to the frame.

The following are non-limiting preferred embodiments other non-limiting aspects of the present invention.

FIG. 1*a* is a back and side perspective view of a bag, generally denoted by the reference numeral 10, which includes a body 12 and a strap 14 forming at least one loop 16. In the view of FIG. 1 a the front and one side of bag 10 is illustrated and strap 14 is configured as a shoulder loop 16. The bag 10 is carried by a user with loop 16 over one shoulder. The of bag 10 is illustrated in FIG. 1A where strap 14 is shown as connected to the bottom corners 28 of bag 10 and extending into tunnel openings 30 at the top center portion of the back surface 32 of the bag 10. The bag is preferably made of a waterproof material. In the illustrated embodiment strap 14, while collectively considered as continuous, is provided with buckles 22 used to lengthen strap 14 and strap loop fittings 24 as part of the conventional two-part lengthening arrangement of strap 14.

Therefore, strap 14 may be lengthened using the two-part lengthening arrangement of strap 14 and two loops pulled out of the respective tunnels as described below in connection with FIG. 1B to realize the configuration where backpack loops 34 are provided. The arms of the user may then be put through loops 34, which are then arranged over the shoulders. Tunnels 36 are shown in dotted outline in FIG. 4 as extending from opening 30 in back surface 32 of bag 10 from the center upper portion of back surface 32 to the an upper corner opening 38. Tunnels 36 form closed waterproof tubes or sleeves with opposing open ends 40 through which strap 14 is led. Tunnel ends 40 are sealed to openings 30 and 38 in bag 10 to provide a waterproof coupling therebetween. Tunnel 36 may be fixed to the inside surface of bag 10, fixed to the outside surface of bag 10, or may be free from the inside or outside surface. The inner diameter or dimensions of tunnel 36 are sized to allow strap 14 to be easily drawn therethrough in either direction. Stop 26 can be seen in FIG. 4 in an interference fit or relationship to opening 30, thereby preventing strap 14 from being moved further into tunnel 36 and hence providing a support point of strap 14 for bag 10 when it is loaded.

It is to be understood that stop 26 may take many other forms and constructions to provide a body or element that attaches to strap 14 and provides an interference fit to the openings 30, 38 of tunnels 36, all of which are included within the spirit and scope of the illustrated embodiments.

Figure 9A:
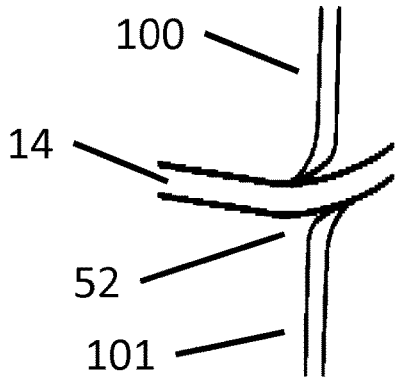
FIG. 9A-9G are plan or side elevational views of a plurality of embodiments of the squeegee used to clamp and wipe the strap at an opening of a strap guide tunnel.
Figure 9B:
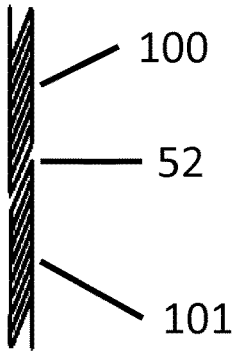
Figure 9E:
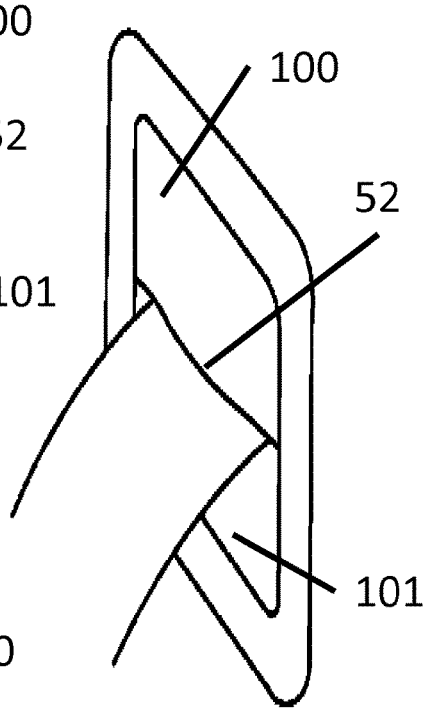
Figure 9C:
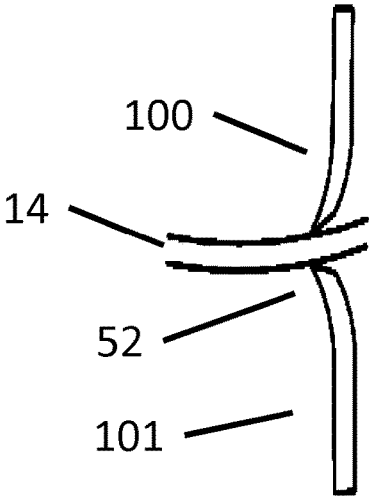
Figure 9D:
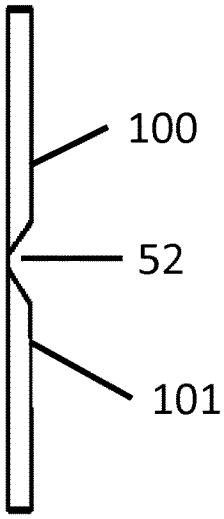
Figure 9F:
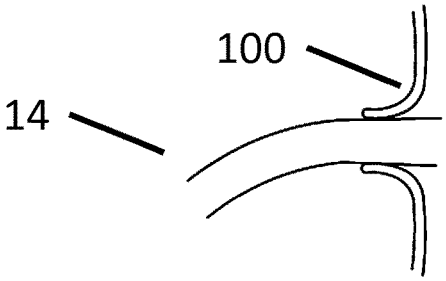
Figure 9G:
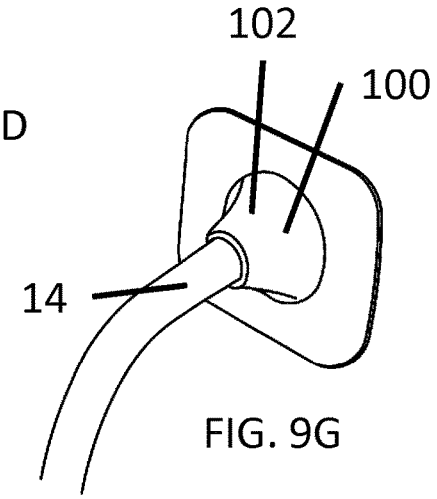

For waterproofing, the bag 10 may comprise a waterproof or water absorbing closure ("closure") 100. FIG. 1A shows a closure 100 connected to the opening 30 made in the back surface of bag 10 wherein the tunnel 38 is connected in a waterproof seal. The closure may be attached to the strap 14, or fit to the openings 30, 38 of tunnels 36. FIG. 9A-G are plan or side elevational views of a plurality of embodiments of a squeegee used to clamp and wipe the strap 14 at an openings 30, 38 of tunnels 36. In FIGS. 9B and D the closure is a pair of squeegees, wherein the pair of squeegees 100 and 101 are configured to form an opening that is smaller than a cross section of the continuous strap when the continuous strap is not disposed therethrough. In FIG. 9 A-E, the closure is a pair of squeegees configured to form an openable slit 52. FIGS. 9A, C, and E shows the strap 14 disposed through the pair of squeegees 100 and 101. In FIGS. 9 F and G the squeegee 100 forms a funnel 102. In another embodiment not shown, a closure is a plastic or polymer clip lock similar to a hair barrette which has a openable slit 52 either using a hinge (not shown) or the flexibility of the material of stop 26*a* to widen slit 52, then to close slit 52 onto strap 14 wherein end 54 of stop 54 has a resilient tooth-and-flange snap or lock 56 to remain tightly clamped onto strap 14.

Figure 1B:
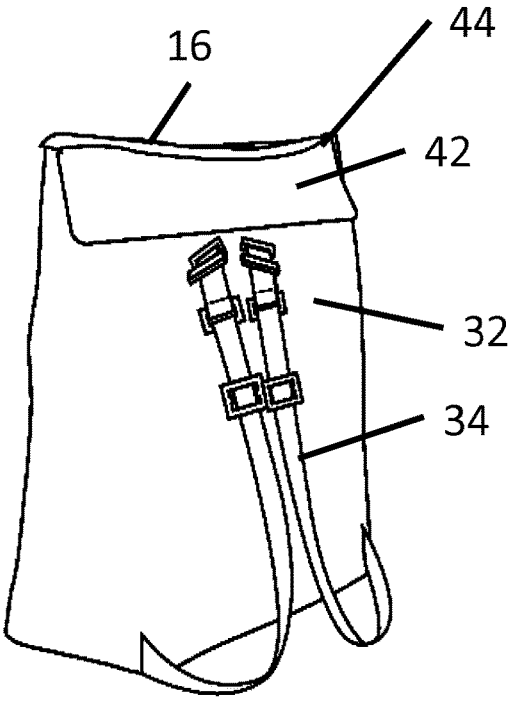

FIG. 1B also shows a top flap 42, to provide a top covering for bag 10. It is to be understood that top flap 42 may be longer to cover the straps 34. In the view of FIG. 1B, flap 42 has been folded onto the back surface 32 of bag 10 and the opposing top edges 44 of bag 10 are sealed together to provide a waterproof closure. The sealing of the closure of edges 44 may be realized by any conventional means, such as a tongue-and-groove compression seal, magnetic seal, snap seal, or similar seal, which may or may not include a gasket, affixed to the inner opposing upper surface of edges 44. Bag 10 is shown in the sealed configuration in the view of FIG. 1B when it is being used in the backpack configuration as selected by the user.

It can now be readily appreciated that when straps 14 are pulled out in the configuration of FIG. 1B, that the shoulder loop 16 formed by strap 14 is drawn into tunnel 36 until it is flatly along the top edge 44 of bag 10 so that there is no dangling open loop left. Similarly, when the shoulder bag configure of FIG. 1A is chosen, strap loops 34 are drawn into tunnels 36 so that strap 14 lies flatly against back surface 32 of bag 10 without any dangling open or loose loops.

Figure 2A:
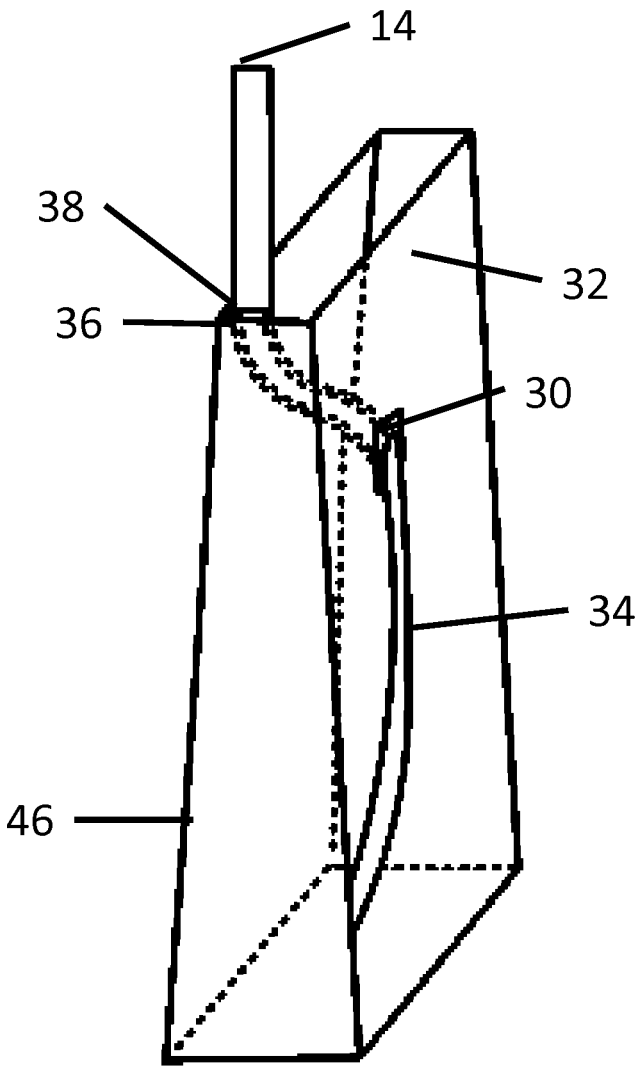
FIG. 2A is a perspective view of some of the embodiments, showing a phantom view of an interior tunnel of the embodiment of FIG. 1A.

Embodiment of FIG. 1A-B illustrate an embodiment in which tunnel 36 is laid out in a generally diagonal direction across the back surface 32 of bag 10. However, the opening 38 of tunnel 36 may be through or adjacent to the adjacent side 46 of bag 10 as best shown in FIG. 2A which is an internal view of bag 10. Thus, bag 10 has front, side, back, bottom and top surfaces extending in three dimensions, so that one surface does not occupy the same planes in space as the adjacent surfaces, but tunnels 36 direct or carry strap 14 from one surface of bag 10 to another in any one of the three dimensions. For example, as will be seen in the embodiment of FIG. 3A a tunnel 36 is provided which leads or carries strap 14 across the interior of bag 10 to and through the opposing surface, namely from back surface 32 to front surface 48. In terms of strap geometry then, tunnels 36 provide the bag designer with complete freedom to lay out the geometrical pattern of strap 14 through bag 10 in any direction without regard to the orientation of the surfaces of bag 10 without any loss in the waterproof quality of the bag 10.

Figure 1C:
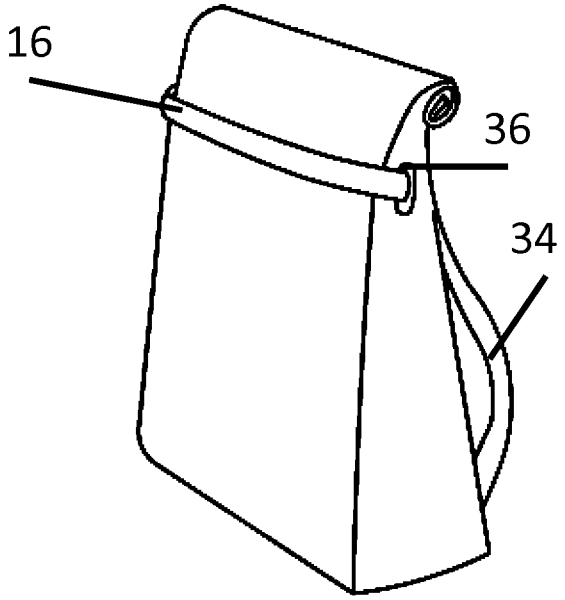
Figure 1D:
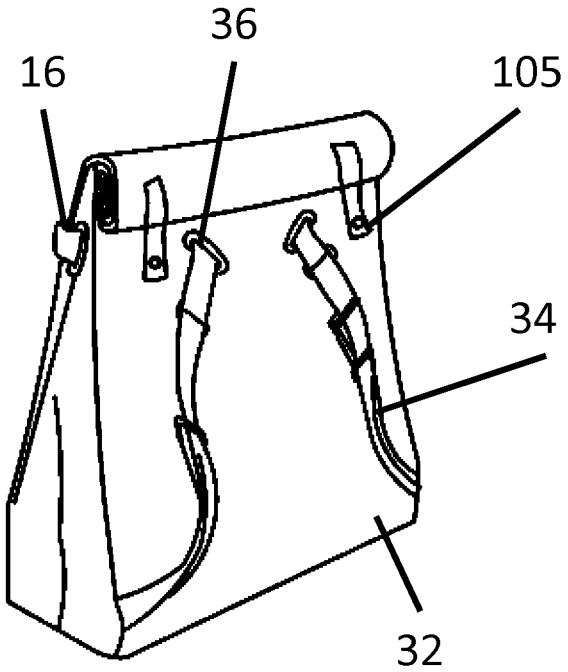
Figure 1E:
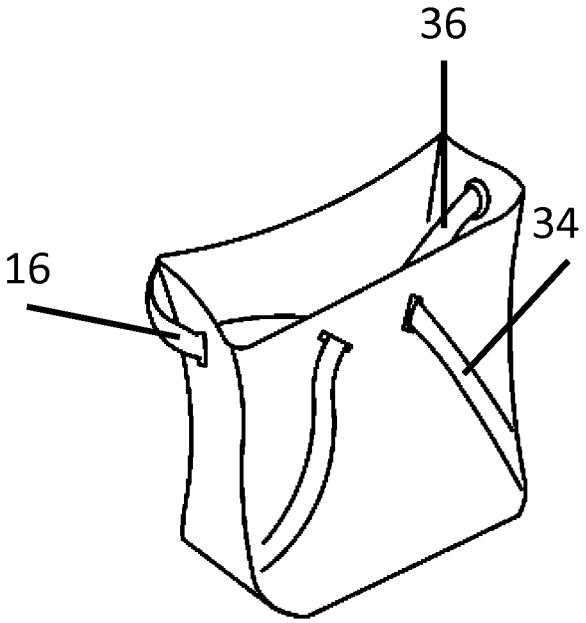
Figure 1F:
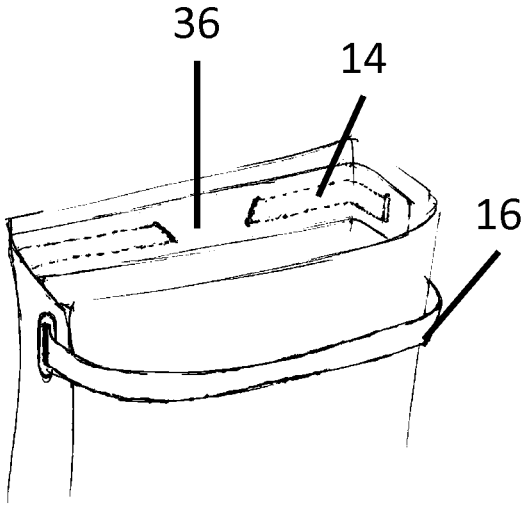
Figure 1K:
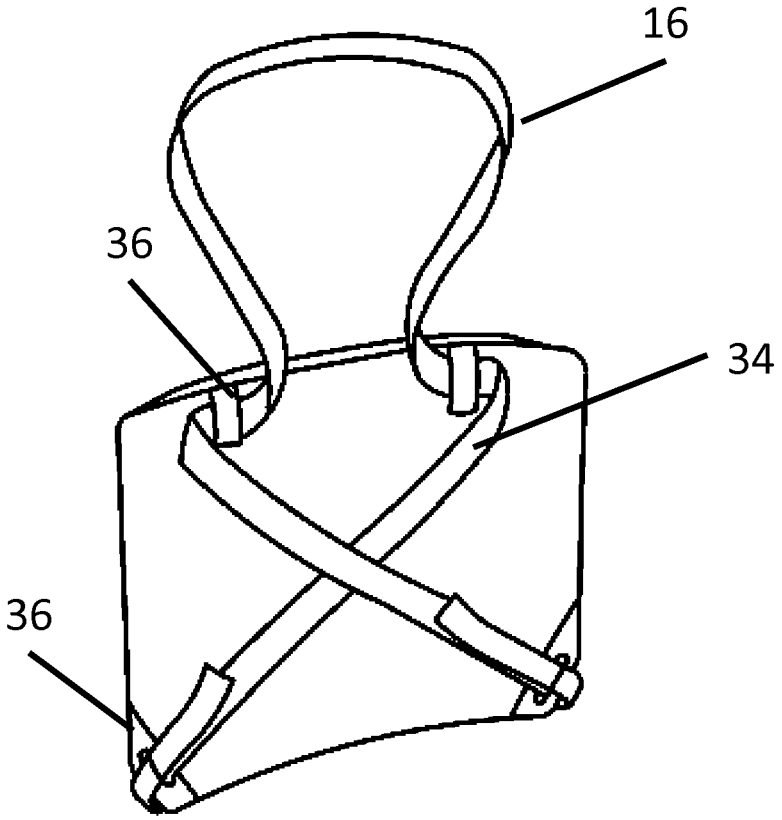
Figure 1L:
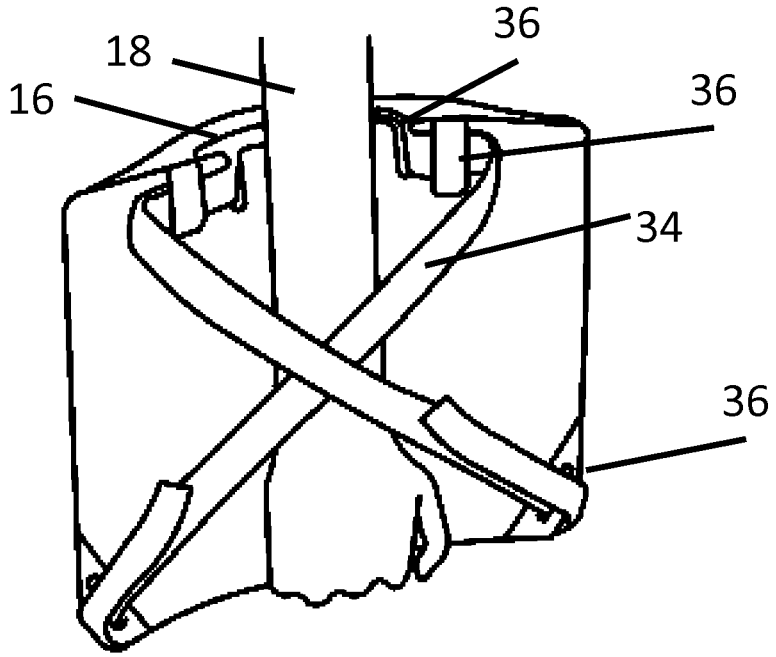
Figure 1M:
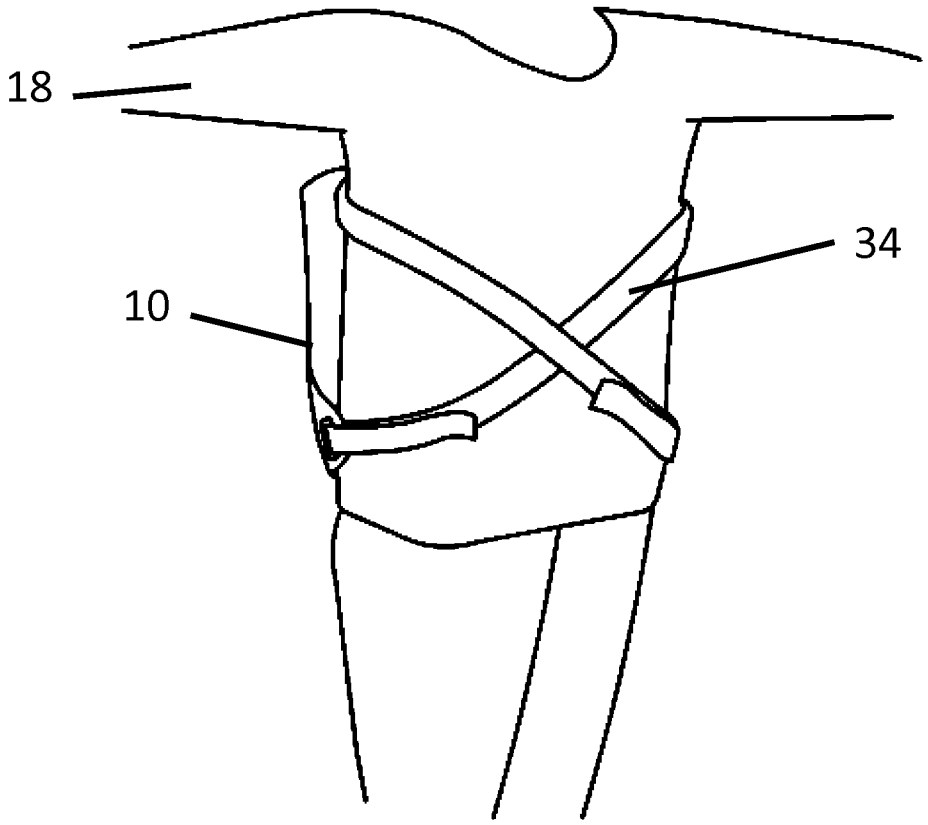

FIG. 1C is a perspective view which shows a bag 10 in the configuration of a hand bag or a messenger bag. FIG. 1D shows a back perspective view of bag 10 of FIG. 1C in a closed position. FIG. 1E shows a top perspective view of bag 10 of FIG. 1C in an open position with tunnels 36 which are connected to the bag at only the openings formed in the bag surface. FIG. 1F shows a top perspective view of bag 10 of FIG. 1C in an open position with the tunnel 36 connected to the bag 10 along the entire length of the tunnel 36. FIG. 1G is a perspective view which shows a bag 10 in the configuration of a hand bag. FIG. 1H is a perspective view which shows a bag 10 of FIG. 1G with tunnels 36 through the back surface 32 of bag 10. FIG. 1I is a perspective view which shows a bag 10 of FIG. 1G with tunnels 36 through the bottom surface of bag 10. FIG. 1J is a perspective view which shows a bag 10 of FIG. 1G in a backpack configuration. FIG. 1K is a perspective view which shows a bag 10 in the configuration of a hand bag or messenger bag, where strap 34 is drawn flatly against bag 10 by being pulled into tunnels 36 and loop 16 is drawn out. FIG. IL is a perspective view which shows a user 18 carrying bag 10 of FIG. 1K in the configuration of a wrist bag, where loop 16 is drawn flatly against bag 10 by being pulled into tunnels 36. FIG. 1M is a perspective view of a user 18 using bag 10 of FIG. 1K as a fanny pack bag. It can now be appreciated that FIG. IC and FIG. 1B which shows carrying bag 10 in the configuration of a backpack can also be used as a messenger bag where loop 35 of FIG. 1C or one of loops 34 of FIG. 1B is capable of being pulled out to form a large loop (not shown) and the other strap loop 34 of FIG. 1B is capable of being drawn flatly (not shown) against the back surface 32 of bag 10. The enlarged single loop 34 is then rotated to the front of bag 10 and over the head, shoulder and across the chest of user 18.

Figure 4:
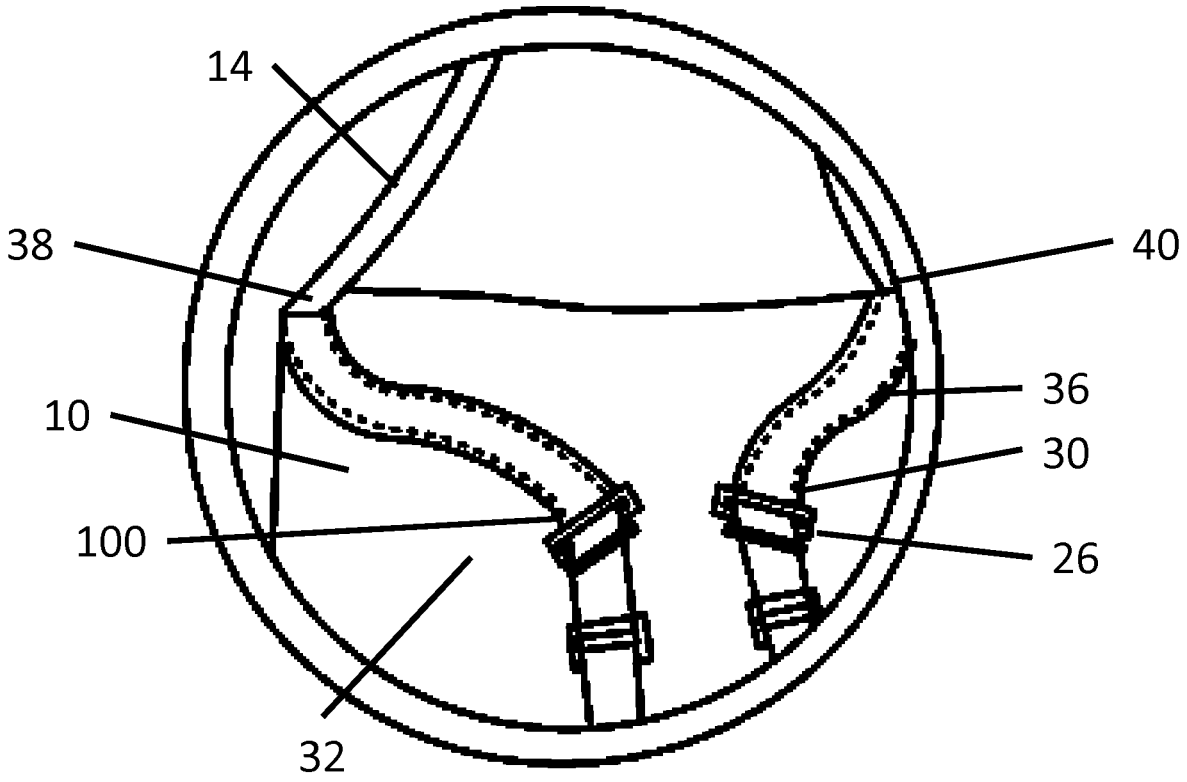
FIG. 4 is a back elevational view of the strap and tunnel shown in phantom in enlarged scale for the upper portion and corner of the bag of FIGS. 1*a, b, e, f, g*, and *h*.

The detail of the strap entry into tunnel 36 is better seen in the plan elevational view of FIG. 4, where openings 30 are defined as close fitting slits, which will tend to seal against strap 14 and which will wipe any water from strap 14 as it is drawn into tunnel 36. Opening 38 is provided with a similar close fitting slide (not shown). As discussed below the tunnel openings 30 and 38 may also include squeegees on both edges of the slit to provide even better sealing and wiping of strap 14.

Figures 3A, 3B, 3C, 3D:
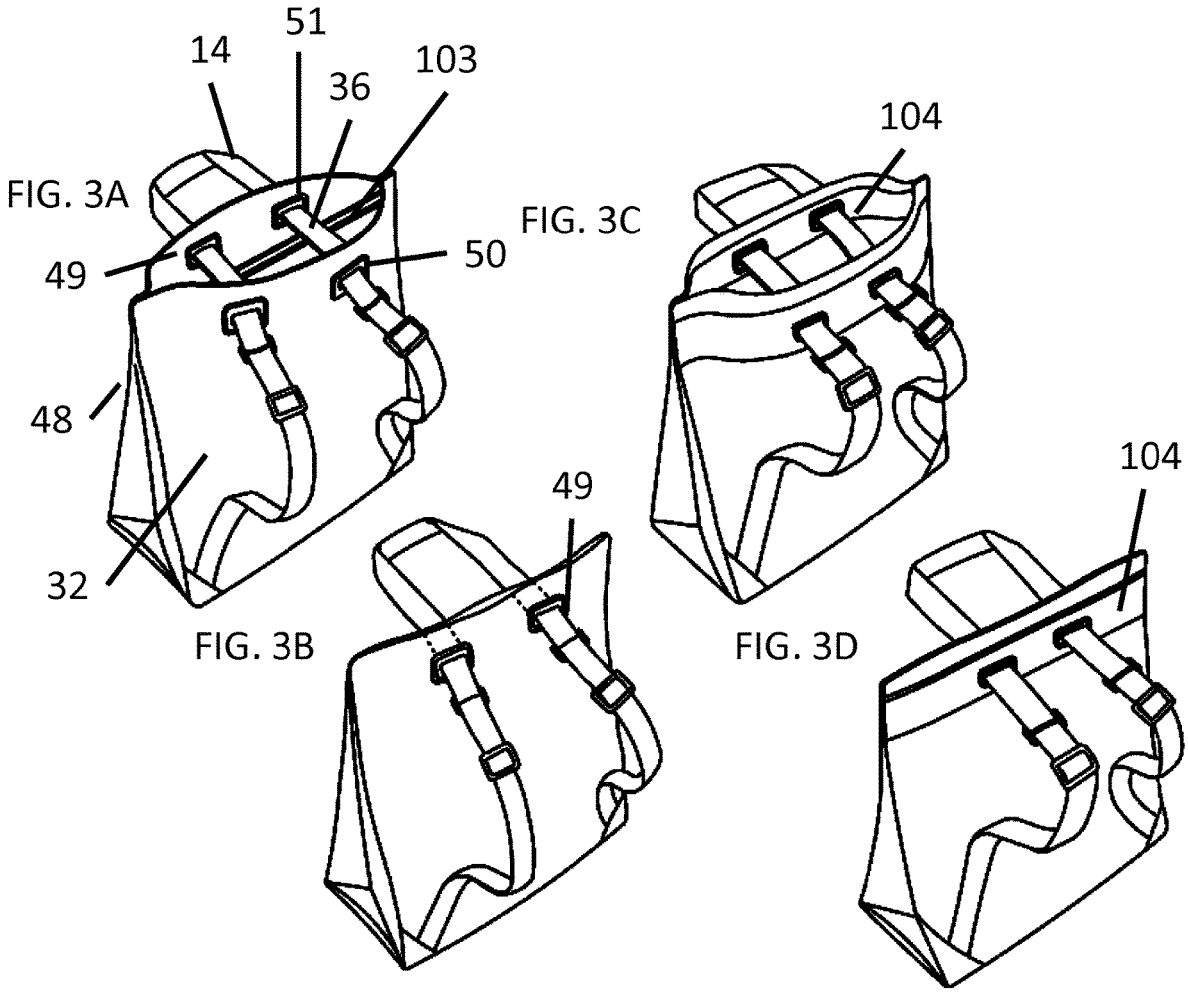
FIG. 3A-3D are perspective views of another embodiment with snap openings, squeegees, tunnels, and a tongue and groove seal closure are in an snap opening open and closed configuration; and an embodiment with a magnetic seal with squeegees, without tunnels, in an open and closed configuration are shown respectively.

FIG. 3A-3D are perspective views on another embodiment wherein connector assemblies or snap fittings 49 are used in combination with and without tunnels 36. In FIG. 3A a perspective view of bag 10 is shown in which each snap fitting 49 is shown as separated into its two parts 50 and 51. Strap 14 is disposed through each part 50 into its opposing part 51 so that strap 14 is disposed across the top opening of bag 10 into opposing snap part 51 and then out of bag 10. FIG. 3B is a perspective view of the bag 10 of FIG. 3A with both snap fittings 50 and 51 connected together to close the top of bag 10. When snap fitting 49 is connected together in a closed configuration it is waterproof. As discussed above the top edges 44 of bag 10 may include additional sealing mechanisms, such as a tongue-in-groove compression seal 103 as show in FIG. 3A in an open position and in FIG. 3B in a closed position, a magnetic seal 104 as shown in FIG. 3C in an open position and in FIG. 3D in a closed position, snap seal 49, or similar seal, which may or may not include a gasket, to close bag 10 in a waterproof manner.

In FIG. 3C a perspective view of bag 10 is shown in which each snap fitting 49 is shown as separated into its two parts 50 and 51. Tunnel 36 couples each part 50 with its opposing part 51 so that strap 14 led through snap part 50 is disposed in tunnel 36, disposed across the top opening of bag 10 inside tunnel 36 into opposing snap part 51 and then out of bag 10 in a waterproof disposition. Tunnel 36 is made of flexible, waterproof material in this embodiment, which allows it to collapse and allow snap fittings 50 and 51 to be connected or snapped together to form a completed and seal snap fitting 49. FIG. 3D is a perspective view of the bag 10 of FIG. 3C with both magnetic fittings 104 connected together to close the top of bag 10. The openings of snap fittings 50 and 51 may also include a slit squeegee to better seal against strap 14 and to wipe any water from strap 14 as it is pulled through fitting 49. As discussed above the top edges 44 of bag 10 may include additional sealing mechanisms, such as a tongue-in-groove compression seal 103, magnetic seal 104, snap seal 49, or similar seal, which may or may not include a gasket, to close bag 10 in a waterproof manner.

The embodiment of FIG. 1C and FIG. 1D illustrate a configuration where the top of bag 10 is sealed by rolling the top of bag 10 and optionally locking the top in position by snaps 105 to form an internal waterproof closure Still further bag 10 could be combined with a variety of frames 70 for shaping or spacing as shown in FIG. 5A-FIG. 8C. FIG. 5B shows an X-frame 70 comprised of two resilient poles 72, 74, made of metal, plastic, fiberglass, or similar material, rotatably bound at their centers which can be fitted into bag 10 by use of a variety of mechanisms, such as a connector which can include, but is not limited to, grommets, pockets 76, sleeves, pins, bolts, hooks, loops, and similar items, to extend bag 10 outwardly from the back of user as depicted in FIG. 5D. In one embodiment, the mechanisms used to fit the frame into the bag, such as the connectors, can also be spaced to maintain the shape of the frame. In another embodiment, the mechanism may also be used to bow the frame.

Figure 5A:
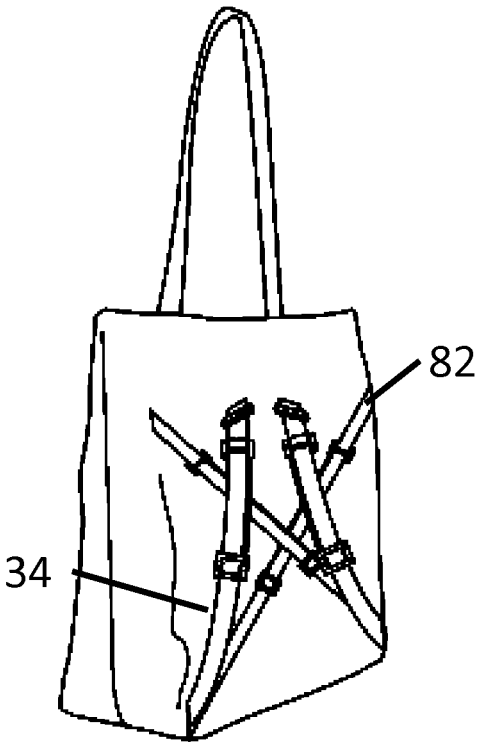
FIG. 5A-5D are diagrams showing a plurality of embodiments wherein a plurality of resilient poles are combined with the strap to provide a variety of tensioned frames that can be incorporated into the bag to provide it a shape or a frame to space it from the user's back when carried as a backpack.
Figure 5D:
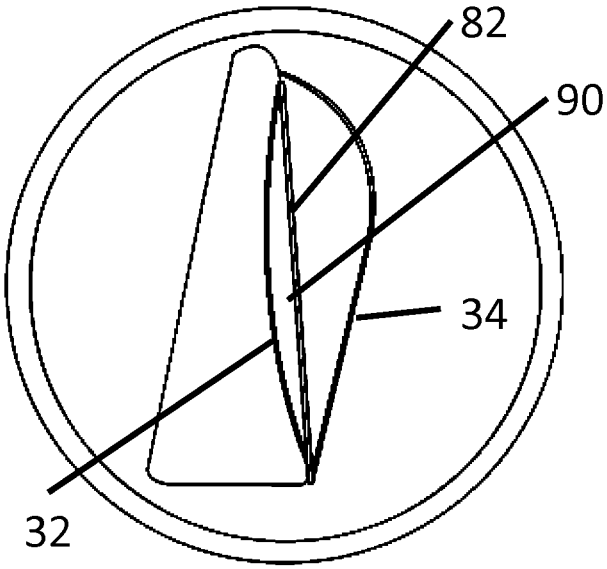
Figure 5B:
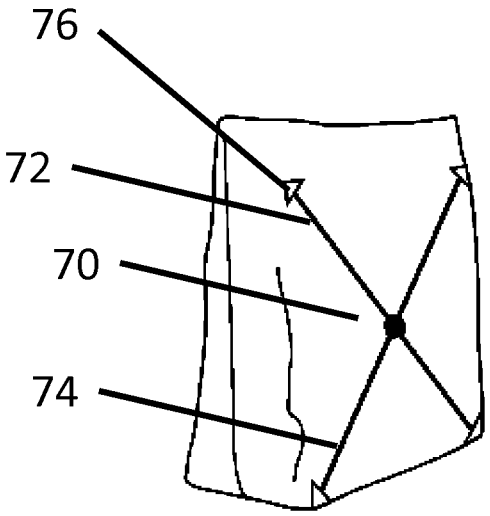

FIG. 5B shows how frame 70 may be attached or accommodated in the interior of bag 10. The ends of poles 72 and 74 may be disposed in one of multiple grommet holes defined in each corner of bag 10. Stops provided on the ends of poles 72, 74 (not shown) allow poles 72, 74 to be bowed to tension the material of bag 10 between the grommet holes in opposing corners. The grommet holes are replaced by the corner pocket flaps 78 of FIG. 5B.

Figure 5C:
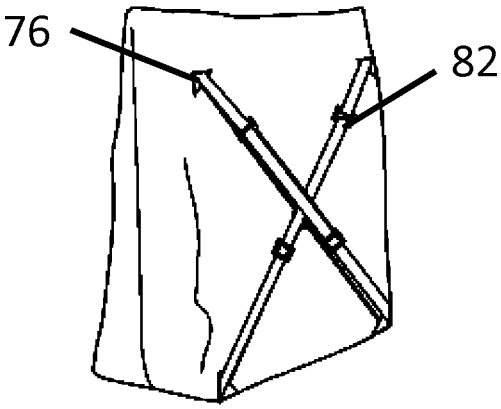

In addition to the X-frame 70 shown in FIG. 5B, bowed parallel poles 72, 74 may be used by disposing poles 72, 74 into two parallel vertical tunnels 36 fixed or disposed within bag 10 and then bowing the poles 72, 74 using crossed tensioned strap 82 connected to opposing top and bottom ends of opposing parallel poles 72, 74 as shown in FIG. 5D. The frame 70 formed by this assembly is retained in bag 10 by retention of poles 72, 74 in pockets 76. Strap 82 may be a single strap led through tunnels 36 with poles 72, 74 or may be two separate segments. FIG. 5A shows the bag 10 with strap 34 and tensioner straps 82. FIG. 5C shows the bag 10 without the strap 34 for a clearer view of the tensioner strap 82 in an X configuration.

Alternatively, bowed poles 72, 74 may be crossed in an X shape by two non-adjustable straps, and set into bag 10 as a tensioned frame.

Still further, an X-frame 70 inserted into the bag 10 is comprised of bowed crossed poles 72, 74 tensioned and bowed by use of a single strap led in a rectangular path from each pole end to the next adjacent pole end.

In addition a tensioner or frame adjustor straps 82 may be on each vertical side of the back of bag 10. A tensioner can apply tension to the frame by adjusting the tensioner. The tensioner can be, but is not limited to, an adjustable strap, a pull wire, a threaded rod or bolt, a non-extendable strap or wire, and similar items. X-frame 70 may also be attached to the interior of bag 10 by an adhesive or a plurality of conventional fasteners along its length. Alternatively, X-frame 70 may be attached to the interior surface of bag 10 by a covering which hides X-frame 70. For example, X-frame 70 may be covered entirely and hidden by a fabric sheet that is in turn attached to the interior of bag 10. Alternatively, X-frame 70 may be disposed and hidden in tubular webbing, which in turn is attached to the interior of bag 10. FIG. 5D is a side plan view which illustrates that when frame adjustor straps 82 are shortened or tightened, frame 70 inside of the bag 10 bows inwardly curving the back surface 32 of bag 10 with it to create a ventilation space 90 between the frame adjustor straps 82 and user's back and the back surface 32 of bag 10. Since the material of bag 10 is waterproof, it possibly may not breathe freely and thus when kept in close proximity to the user's back allows heat and sweat to be easily built up between the user's back and back surface 32 of bag 10. The bowing of bag 10 by frame 70 creates a ventilation space 90 whereby this contact and discomfort is avoided.

Figure 6A:
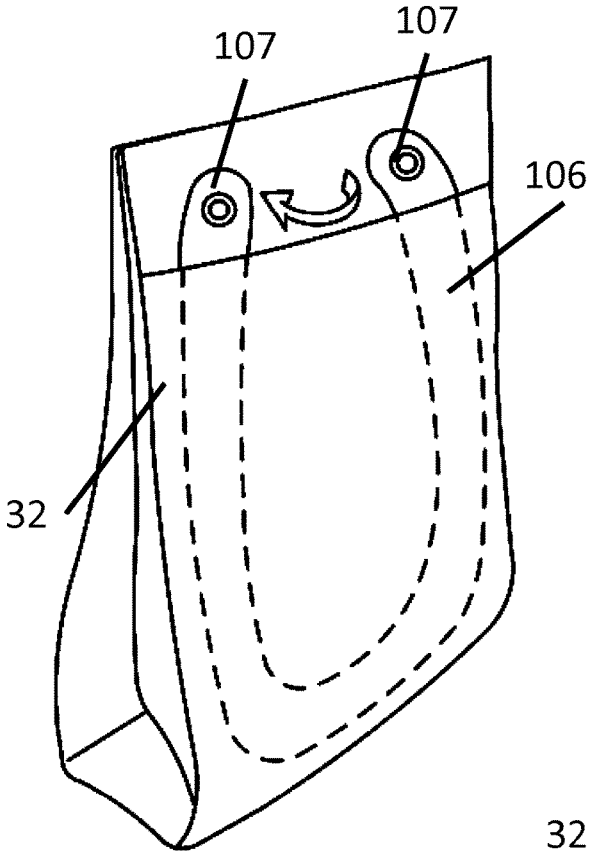
FIG. 6A-6B are diagrams showing a plurality of embodiments wherein a U shaped flexible material is incorporated in the bag as a frame in a non-tensed and tensed configuration, respectively, to provide it a shape or a frame to space it from the user's back when carried as a backpack.
Figure 6B:
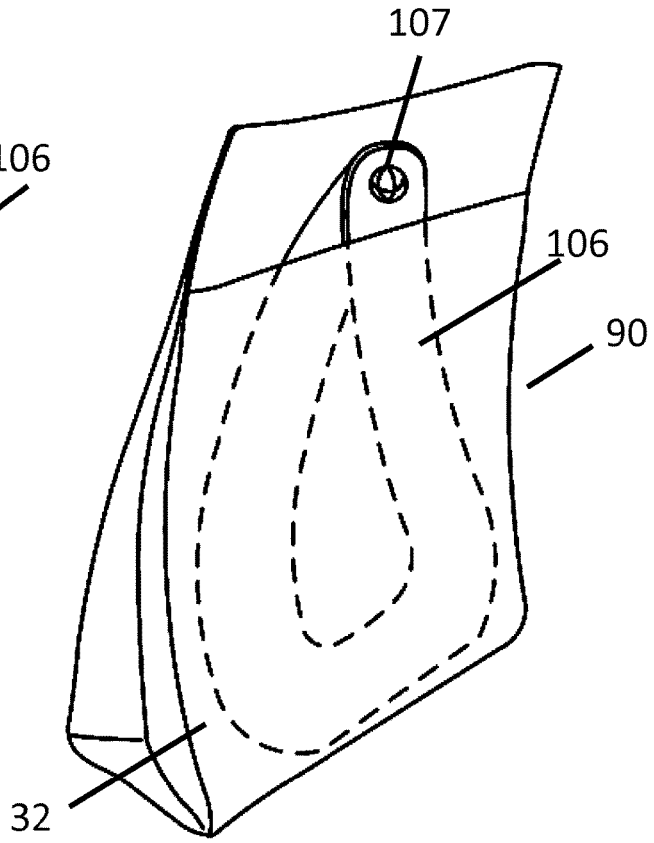

FIG. 6A-6B are diagrams showing a plurality of embodiments wherein a U shaped flexible frame 106 is incorporated in the bag 10. FIG. 6A shows the frame in a non-tensed configuration. FIG. 6B is a perspective view of the frame 106 in a tensed configuration, such tensing bows the frame and moves the back surface of the bag 32 to form a ventilation space. In FIG. 6B the frame 106 is locked in a tensed configuration by snaps 107.

Figure 7A:
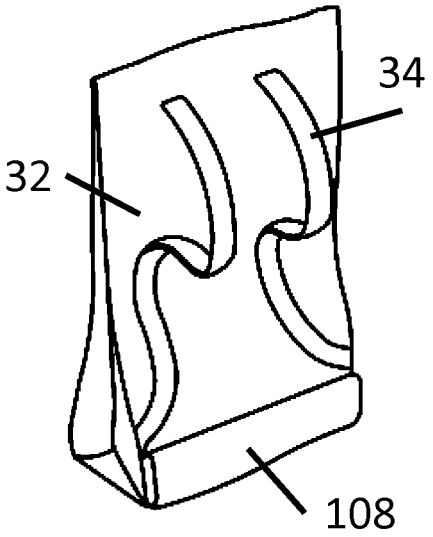
FIG. 7A-7E are perspective views of an embodiment where a frame comprising a hinged shelf is combined with the bag in a closed and open configuration, respectively, to create a space between the user's back and the bag.
Figure 7B:
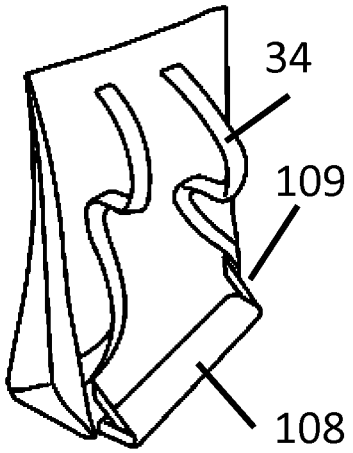
Figure 7C:
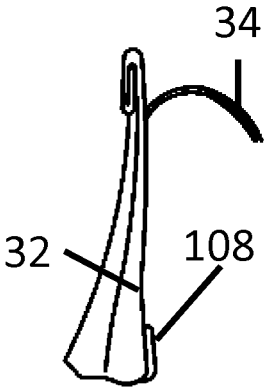
Figure 7D:
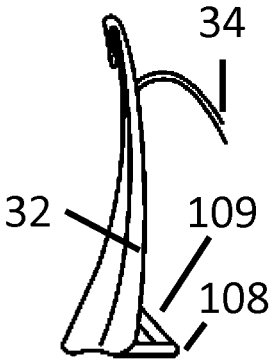
Figure 7E:
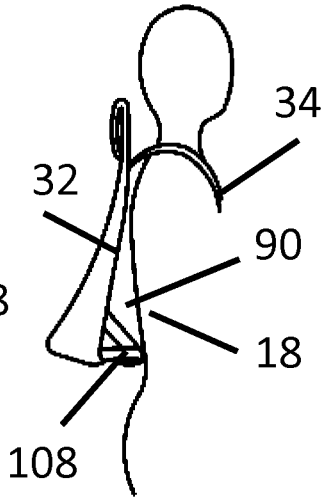

FIG. 7A-7E are perspective views of an embodiment where a frame comprising a hinged shelf 108 is combined with the bag in a closed and open configuration, respectively, to create a space 90 between the user's back 18 and the bag 10. FIGS. 7A and 7C are perspective views from the back and from the side, respectively, of the hinged shelf 108 in a closed position. FIGS. 7B and 7D are perspective views from the back and from the side, respectively, of the hinged shelf 108 in an open position which a locking bar 109 in place to lock hinged shelf 108 in an open position. FIG. 7E is a perspective view of a user 18 wearing a bag 10 with the hinged shelf 108 in the open position, creating a ventilation space 90 between the back of the user 18 and the back surface of the bag 32. The hinged shelf 108 is connected to the back surface 32 of the bag 10 in FIG. 7A-7E; however, the it is contemplated that it may be connected to another surface.

Figures 8A, 8B, 8C:
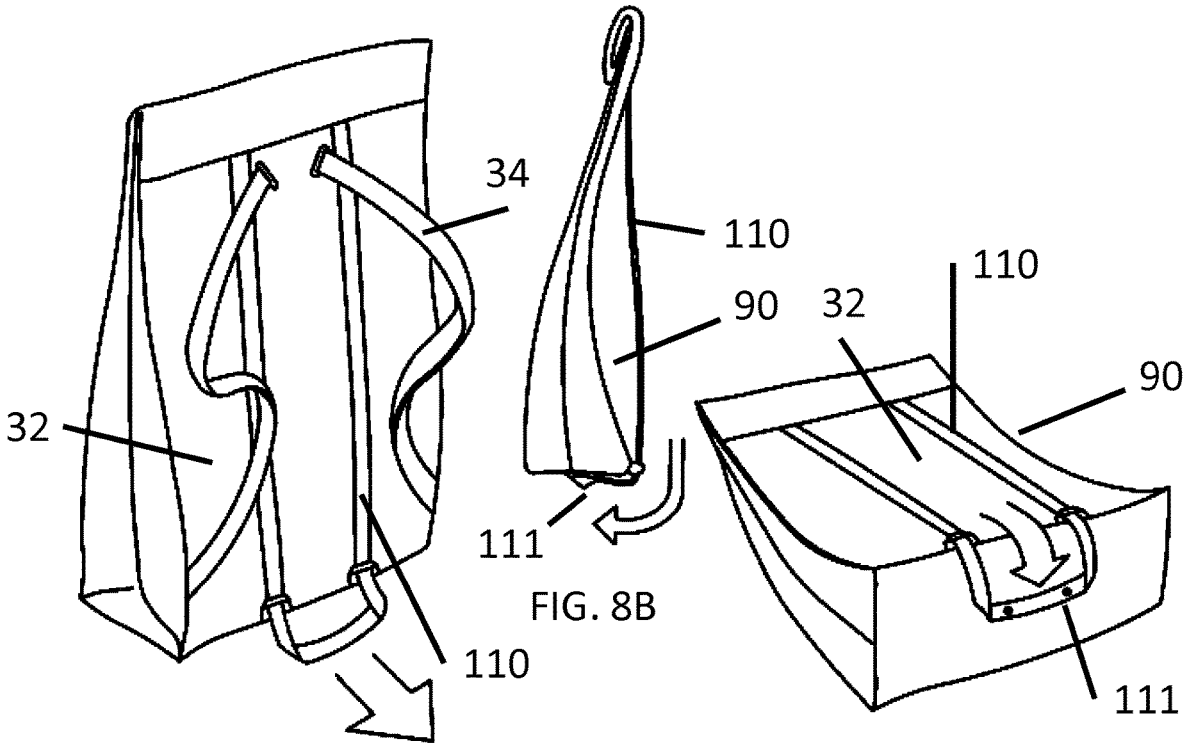
FIG. 8A-8C are perspective views of an embodiment where a tensioner comprising straps are combined with the bag to provide tension to the frame, the tensioner straps alternatively comprise snaps to connect and lock the tensioner straps to the bag.

FIG. 8A-8C are perspective views of an embodiment where a tensioner 110 comprising straps are combined with the bag 10 to provide tension to the frame, the tensioner straps 110 are shown here with a snap 111 that locks the tensioner 110 in the position that tenses the frame. FIG. 8A is a perspective view of a bag 10 with the tensioner strap 110 in the tensioned position. FIG. 8B is a side perspective view of a bag 10 with the tensioner strap 110 in the tensioned position creating a ventilation space 90, the tensioner strap 110 is immobilized by connection to the bag 10 by engagement of the snaps 111. FIG. 8C is a bottom perspective view of a bag 10 with the tensioner strap 110 in the tensioned position, creating a ventilation space 90 and the tensioner strap 110 locked in the tensioned position by connecting the tensioner strap 110 to the bag 10 by engagement of the snaps 111.

The present bag and strap guide are not intended to be limited to the particular forms disclosed. Rather, they include all modifications, equivalents, and alternatives falling within the scope of the claims. For example, while the waterproof or water absorbing closure or partial closure of the apparatus depicted in the figures is shown as a slit in some figures, in other embodiments waterproof or water absorbing closure or partial closure comprises a gasket.

The claims are not to be interpreted as including means-plus- or step-plus-function limitations, unless such a limitation is explicitly recited in a given claim using the phrase (s) "means for" or "step for," respectively.

All of the apparatuses disclosed and claimed herein can be made and executed without undue experimentation in light of the present disclosure. While the compositions and methods of this invention have been described in terms of preferred embodiments, it will be apparent to those of skill in the art that variations may be applied to the apparatus herein without departing from the concept, spirit and scope of the invention. More specifically, it will be apparent that mechanisms which are functionally related may be substituted for the mechanisms described herein while the same or similar results would be achieved. All such similar substitutes and modifications apparent to those skilled in the art are deemed to be within the spirit, scope and concept of the invention as defined by the appended claims.

The invention claimed is:

1. A multi-configuration bag comprising:

a bag body including an interior compartment and a plurality of exterior surfaces;

a first opening;

a second opening;

a third and fourth openings disposed on a first surface of the plurality of exterior surfaces;

a strap guide including a first and second tunnels, the first tunnel extending between the first opening and the third opening, and the second tunnel extending between the second opening and the fourth opening; and a strap slidably disposed through the strap guide, wherein in a first bag configuration, a middle section of the strap is configured to extend away from the first and second openings, and a first and second side sections of the strap are pressed against the first surface.

2. The bag of claim 1, wherein in a second bag configuration, the first and second side sections of the strap are configured to extend away from the first surface; and the middle section of the strap is configured to be in proximity to a second surface.

3. The bag of claim 1, wherein in a second bag configuration, the first and second side sections of the strap are configured to extend away from the first surface; and the middle section of the strap is configured to be in proximity to the first and/or a second surface.

4. The bag of claim 1, wherein a first and second opposing ends of the strap are attached to the bag body.

5. The bag of claim 4, wherein the first and second opposing ends of the strap are attached to a bottom half of the bag body.

6. The bag of claim 1, wherein the first surface is a back surface and a second surface is a front surface.

7. The bag of claim 1, wherein the first opening is disposed on a first side of the bag body and the second opening is disposed on a second side of the bag body.

8. The bag of claim 1, wherein the first and second openings are defined in the interior compartment of the bag body.

9. The bag of claim 1, wherein the first and second tunnels are made of waterproof material, and the first, second, third, and fourth openings are configured to prevent water penetration.

10. The bag of claim 1, wherein at least one of the strap, the interior compartment, and the plurality of exterior surfaces are waterproof, the strap configurable to be disposed through at least one device made of waterproof material, each of the devices configurable as at least one of a clamp, funnel, cap, gasket, squeegee, roller, pressure plate, pressure bar, and slit.

11. A multi-configuration bag comprising:

a bag body including an interior compartment and a plurality of exterior surfaces;

a first opening;

a second opening;

a third and fourth openings disposed on a first surface of the plurality of exterior surfaces;

a strap guide including a first and second tunnels, the first tunnel extending between the first opening and the third opening, and the second tunnel extending between the second opening and the fourth opening; and a strap having a first and second opposing ends, the strap slidably disposed through the strap guide, and the first and second opposing ends of the strap are configured to connect to a bottom half of the bag body, wherein a middle section of the strap is configured to extend away from the first and second openings and a first and second side sections of the strap are pressed against the first surface in a first bag configuration, and the first and second side sections of the strap are configured to extend away from the first surface and the middle section of the strap is configured to be in proximity to the first and/or a second surface in a second bag configuration.

12. The bag of claim 11, wherein the first opening is disposed on a first side of the bag body and the second opening is disposed on a second side of the bag body.

13. The bag of claim 11, wherein the first and second openings are defined in the interior compartment of the bag body.

14. The bag of claim 11, wherein the first surface is a back surface and the second surface is a front surface.

15. The bag of claim 11, wherein the third and fourth openings are defined in the interior compartment of the bag body.

16. The bag of claim 11, wherein at least one of the strap, the interior compartment, and the plurality of exterior surfaces are waterproof.

* * * * *